US008261633B2

(12) United States Patent
Maxey

(10) Patent No.: US 8,261,633 B2
(45) Date of Patent: Sep. 11, 2012

(54) ADJUSTABLE DIAMETER PIVOT SHAFT FOR A HAND TOOL

(75) Inventor: David Maxey, Oregon City, OR (US)

(73) Assignee: Mentor Group, L.L.C., Oregon City, OR (US)

( * ) Notice: Subject to any disclaimer, the term of this patent is extended or adjusted under 35 U.S.C. 154(b) by 71 days.

(21) Appl. No.: 13/047,248

(22) Filed: Mar. 14, 2011

(65) Prior Publication Data

US 2011/0162211 A1 Jul. 7, 2011

Related U.S. Application Data

(63) Continuation-in-part of application No. 12/079,315, filed on Mar. 26, 2008, now Pat. No. 7,905,023.

(51) Int. Cl.
*B21K 21/00* (2006.01)
*B26B 3/06* (2006.01)

(52) U.S. Cl. ..... 76/119; 30/155; 30/161

(58) Field of Classification Search ..... 30/151–164; 403/26, 119, 120, 297; 76/119, 101.1
See application file for complete search history.

(56) References Cited

U.S. PATENT DOCUMENTS

| | | | | | |
|---|---|---|---|---|---|
| 1,373,993 | A * | 4/1921 | Boe | 30/161 |
| 1,451,607 | A * | 4/1923 | Bates | 30/161 |
| 1,864,466 | A * | 6/1932 | Peterson | 403/365 |
| 2,183,901 | A * | 12/1939 | Weaver | 30/161 |
| 2,559,993 | A * | 7/1951 | Parrigin et al. | 30/161 |
| 2,828,668 | A * | 4/1958 | De Angelis | 351/109 |
| 2,948,573 | A * | 8/1960 | Stamm | 384/505 |
| 3,648,550 | A * | 3/1972 | Rozmus | 81/416 |
| 4,135,284 | A * | 1/1979 | Nakamoto | 29/229 |
| 4,272,887 | A * | 6/1981 | Poehlmann | 30/161 |
| 4,274,297 | A * | 6/1981 | Blurock et al. | 74/424.86 |
| 4,280,265 | A * | 7/1981 | Murphy | 29/229 |
| 4,404,748 | A * | 9/1983 | Wiethoff | 30/161 |
| 4,476,750 | A * | 10/1984 | Murphy | 81/300 |
| 4,938,622 | A * | 7/1990 | Stoerzbach | 403/2 |
| 5,048,979 | A * | 9/1991 | Coates | 384/519 |
| 5,221,146 | A * | 6/1993 | Maruyama | 384/447 |
| 5,964,035 | A * | 10/1999 | Poehlmann | 30/161 |
| 5,979,065 | A * | 11/1999 | Hsu | 30/519 |
| 6,212,779 | B1 * | 4/2001 | Mitchell | 30/161 |
| 6,312,162 | B1 * | 11/2001 | Castle | 384/551 |
| 6,339,981 | B1 * | 1/2002 | Koochin | 81/437 |
| 6,361,239 | B1 * | 3/2002 | Parikh et al. | 403/282 |
| 6,983,677 | B1 * | 1/2006 | Engel | 81/302 |
| 7,905,023 | B2 * | 3/2011 | Westerfield | 30/161 |
| 2003/0164638 | A1 * | 9/2003 | Funk et al. | 297/411.32 |
| 2005/0238274 | A1 * | 10/2005 | Zernikow et al. | 384/517 |
| 2009/0016807 | A1 * | 1/2009 | Koch | 403/26 |
| 2009/0241348 | A1 * | 10/2009 | Westerfield | 30/161 |
| 2009/0275432 | A1 * | 11/2009 | Dell | 474/135 |
| 2010/0137084 | A1 * | 6/2010 | Mevissen et al. | 474/135 |
| 2011/0162211 | A1 * | 7/2011 | Maxey | 30/155 |

* cited by examiner

*Primary Examiner* — Sean Michalski
(74) *Attorney, Agent, or Firm* — Hancock Hughey LLP

(57) ABSTRACT

A folding tool such as a knife has an implement such as a blade pivotally attached to the handle with a pivot shaft, allowing the implement to be rotated from a closed to an open position. The invention allows the diameter of the pivot shaft to be varied, thereby allowing the diameter of the shaft to be effectively increased in the area where the implement rotates about the shaft so that the shaft extends to and makes contact with the interior surface of the bore through the implement, without restricting the ability of the blade to freely rotate about the shaft, minimizing or eliminating any tendency of the implement to wiggle relative to the handle.

20 Claims, 7 Drawing Sheets

ADJUSTABLE DIAMETER PIVOT SHAFT FOR A HAND TOOL

FIELD OF THE INVENTION

This invention relates to hand tools such as knives and other hand tools that are equipped with blades and/or other implements that are pivotally attached to a handle, and more particularly to a method and apparatus for adjusting the diameter of the pivot shaft that attaches the blades and/or other implements to the handle to eliminate relative movement between the implement and the handle.

BACKGROUND

Folding tools such as knives have a handle with opposed halves that are held apart to define a blade-receiving space. A blade is pivotally attached to the handle with a pivot shaft or axle that has its opposite ends secured to the opposite handle halves, and which extends through a bore in the blade. The pivot shaft defines a strong and secure connection between the blade and the handle about which the blade may be pivoted between a closed position in which the blade is stowed safely in the handle, and an open position in which the blade extends away from the handle for normal use.

Although there are many different kinds of structures used for pivot shafts used to attach knife blades to knife handles, an inherent problem with pivoting knives (and other folding tools) is that there is almost always a certain amount of play between the blade and the handle. Thus, in order to enable the blade to pivot freely about the pivot shaft, there must be some tolerance between the outer diameter of the pivot shaft and the inner diameter of the bore in the blade through which the shaft extends. In high quality knives the amount of clearance between the blade bore and the shaft can be minimized, but there still must be enough tolerance to allow the blade to be pivoted relatively easily. This necessary tolerance results in rotational movement of the blade, which is perceived as wobble between the blade and the handle: this phenomena is often colloquially referred to as "tip wobble."

Tip wobble is undesirable because it necessarily reduces the strength of the blade/handle connection. In extreme cases, tip wobble can result in an unsafe tool—this is sometimes a concern with lower quality folding knives. But tip wobble is often present even in the most highly engineered and expensive folding knives and can be both a bother and a structural limitation.

There are several common techniques utilized to eliminate, or at least minimize the amount of tip wobble. The most common approach is simply to reduce the tolerance between the blade bore and the pivot shaft—the closer the tolerance between the pivot shaft and the bore, the lesser the tip is able to wobble. The trade off with this approach is of course that a certain amount of spacing between the blade and the shaft is necessary to allow the blade to pivot freely. With automatic or semi-automatic style knives, an easily pivoting blade is a necessity. As such, this approach has its limitations. Another approach is to add a low-friction bushing around the pivot shaft so that the shaft—bore tolerance may be minimized. As with the other techniques just described, this is an effective way to help minimize tip wobble, but it does not eliminate wobble. Moreover, the bushings tend to wear and degrade over time and as they do so, tip wobble tends to increase.

Another solution relies upon a blade-locking mechanism to minimize relative movement between the blade and handle Some locking mechanisms utilize a 3 point-of-contact lock that forces out the play in the pivot bore. While this technique does help minimize blade movement, not all knife designs can incorporate these kinds of locking mechanisms. Other common locking mechanisms do not alleviate tip wobble.

There is an ongoing need therefore for manufacturing techniques and methods that reduce tip wobble in folding tools such as knives.

The present invention relates to an apparatus and method for establishing a strong, secure interconnection between a folding tool implement and the handle of the folding tool, and which minimizes or eliminates tip wobble while insuring that the implement may be easily pivoted between the open and closed positions. The invention allows the diameter of the pivot shaft to be varied, thereby allowing the diameter of the shaft to be effectively increased so that the shaft extends to and makes contact with the interior surface of the bore through the blade, without restricting the ability of the blade to freely rotate about the shaft.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

Figure 8:
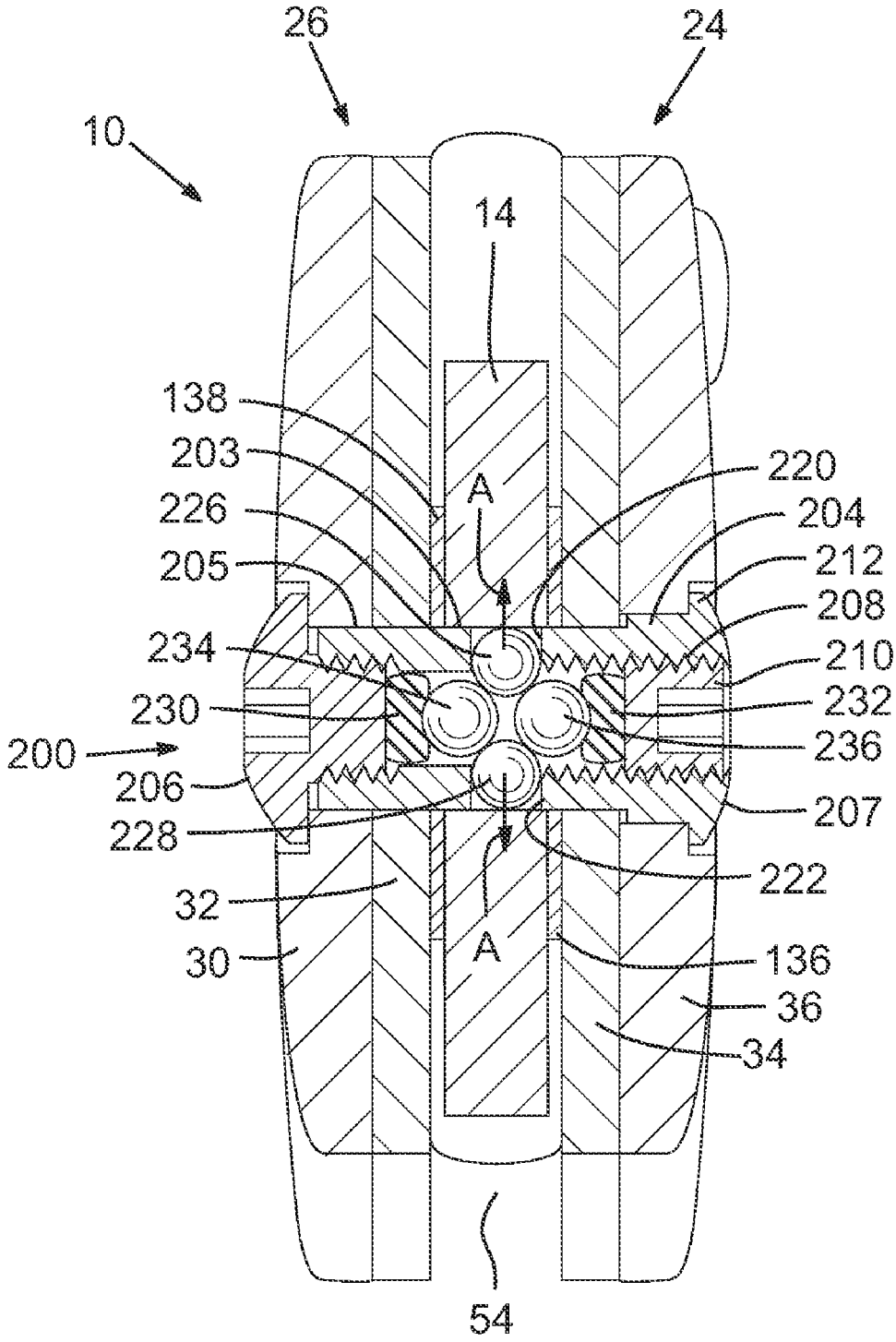
FIG. 8 is a cross sectional view similar to the view of FIG. 3, illustrating an alternative embodiment of the adjustable diameter pivot shaft.

A first illustrated embodiment of a folding knife 10 incorporating an adjustable diameter pivot shaft according to the present invention is illustrated in FIGS. 1 through 7. A first illustrated alternative embodiment of the folding knife that includes an adjustable diameter pivot shaft according to the present invention is illustrated in FIG. 8. It will be appreciated that the present invention is described herein as it is used in a folding knife, but that the invention is equally applicable to other kinds of folding tools that have implements other than the knife blades described herein. Thus, the principals of the invention and the structures that enable the invention may be used in many kinds of folding tools other than knives. Description of the invention as it is used with a knife should thus be considered a way of enabling the invention for those of skill in the art, but not as a limitation to the scope of the invention as defined in the claims.

Figure 1:
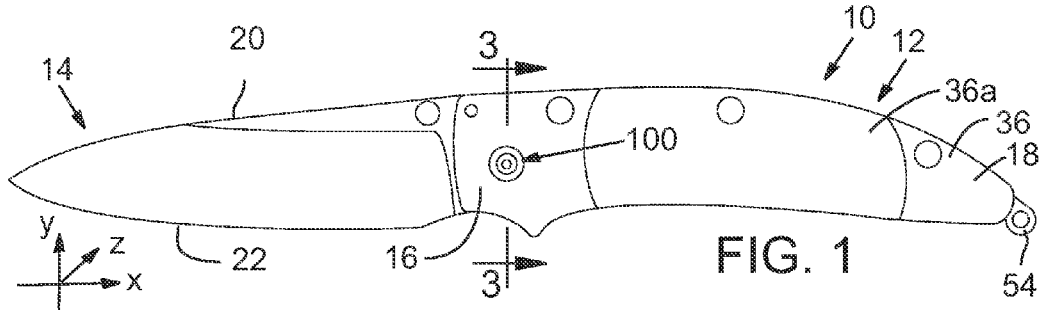
FIG. 1 is a side elevation view of a folding knife of the type that incorporates the adjustable diameter pivot shaft according to the present invention, illustrating the blade of the knife in an open position.
Figure 2:
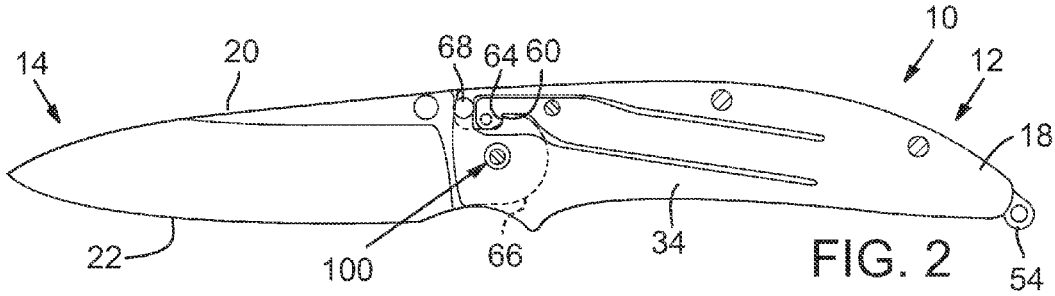
FIG. 2 is a side elevation view of the folding knife shown in FIG. 1 with a portion of the near-side handle removed to expose the near-side liner and other internal structures of the knife.

Folding knife 10 includes an elongate handle 12, and a blade 14 that is pivotally attached to the handle at one of its ends—referred to herein as the "forward" end 16 of the handle. Other relative directional terms correspond to this convention: the "rear" or butt end 18 of the handle is opposite the forward end; the "upper" part 20 of the blade is the dull, non-working portion and the "lower" part 22 of the blade is the sharpened, working portion; "inner" or "inward" refers to the structural center of the knife 10, and so on. FIGS. 1 and 2 show the knife 10 with the blade 14 in the open position. An X-Y-Z axis grid is shown in FIG. 1. The X-Y plane is defined as the plane parallel to the plane defined by the handle 12 and blade 14—the blade travels in the X-Y plane as it is rotated between the closed and open positions. The Z plane is the plane transverse to the X-Y—as detailed below, the blade pivot shaft extends longitudinally in the Z-plane.

Figure 5:
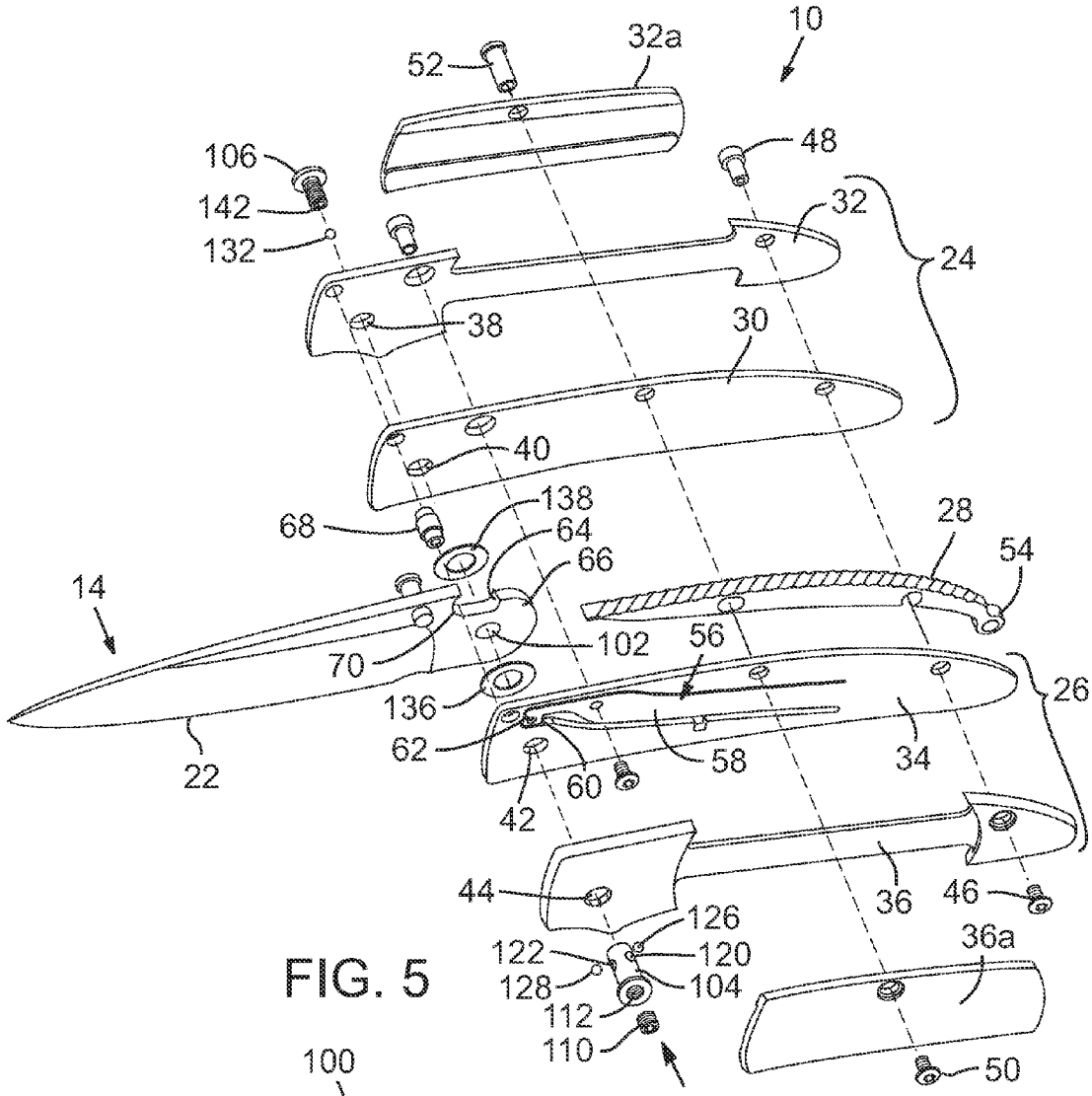
FIG. 5 is a perspective exploded view of the knife shown in FIG. 1.

With reference now to FIG. 5, the various components of knife 10 will be described. Handle 12 of knife 10 comprises several components, including a pair of oppositely located handle halves, generally indicated at 24, 26, that are parallel with each other and held spaced apart from one another by a spacer 28 that is attached between the handle halves along an upper edge thereof. Each of the handle halves 24 and 26 comprise an inner liner and an outer plate that are held parallel to one another. Specifically, handle half 24 is defined by liner 30 and an outer plate 32. Likewise, handle half 26 is defined by liner 34 and outer plate 36. It will be noted that each of the outer plates 32 and 36 includes a decorative center section (32*a* and 36*a*, respectively) that is separately attached to the outer plate. It will be understood that the decorative sections 32*a* and 36*a* could be replaced by making the outer plates solid without the separable decorative sections. Moreover, it will be understood that the handle halves 24 and 26 may be unitary in construction—that is, there is no reason that the handle halves include a liner and an outer plate.

The handle 12 is assembled with blade 14 with various screws and spacers as best shown in FIG. 5. Thus, blade 14 is pivotally connected to handle 12 with a pivot shaft assembly 100, which is described in much greater detail below, and which extends through aligned bores 38 in outer plate 32 and 40 in liner 30, bore 102 in blade 14, and bores 42 in liner 34 and bore 44 in outer plate 36. As detailed below, the interior diameter of bore 44 is formed in a series of planar faces. A screw 46 extends through aligned bores in the rearward portion of the handle halves and the spacer and is threaded into a nut/spacer 48, and a similar screw 50 and nut/spacer 52 are located midway along the length of handle 12 along the upper margin such that the screw spacer 42 extends through the handle halves and the spacer 28. Additional screws may be used in a conventional manner to secure the handle components together and so that a blade-receiving groove 54 (see e.g., FIG. 3) is defined between the handle halves 24 and 26. The blade receiving groove 54 defines a slot into which the blade 14 is received when it is moved to its closed position. When the blade is in the closed position, the sharp edge 22 of the blade is held safely within the confines of the handle. Spacers 48 and 52 are preferably cylindrical sleeves that have a threaded internal bore into which screws 46 and 50 are threaded. The screws thus secure the spacers between the handle halves 24 and 26 to maintain the handle 12 in a secure relationship with handle halves 24 and 26, which are held in a spaced apart relationship. The handle halves 24 and 26 may be fabricated from any suitable material such as metal, a reinforced synthetic plastic; other suitable materials include metal, other plastics, wood, etc. The handle halves sections may be fabricated in singled or multiple pieces, as shown in FIG. 5. Decorative sections 32*a* and 36a may be any kind of material such as fine wood. As shown in FIG. 5, a loop 54 may be added to the rearward end of spacer 28 to define a location to attach a lanyard (not shown) to the knife 10.

Continuing with FIG. 5, knife 10 is shown as including an optional blade locking mechanism 56, which is formed as part of liner 34. Locking mechanism 56 does not form a part of the present invention and is therefore not described in great detail. Nonetheless, the locking mechanism 56 is defined by a spring arm 58 formed in liner 34 that has a tooth 60 formed on the forward end 62 of the spring arm. Spring arm 58 is normally biased under spring force inwardly, toward blade 14 in the assembled knife so that when the blade is in the open position the tooth 60 cooperates with a notch 64 in the tang portion 66 of blade 14 to lock the blade in the open position. A stop pin 68 is secured between liners 30 and 34 and stops rotation of blade 14 in the open position by abutting a cooperatively formed notch 70 in the tang 66 of blade 14. Thus, when the blade 14 is in the fully open position of FIG. 1, stop pin 68 is in an abutting relationship with notch 70 and locking mechanism 56 is locked such that tooth 60 is engaging notch 64.

As noted, the blade 14 is pivotally attached to the handle 12 near the forward end of the handle with a pivot shaft assembly 100. Blade 14 is attached to handle 12 such that the blade's working portion 22 extends away from the handle 12 when the blade 14 is in its open position (FIG. 1), and tang portion 66 is located within the blade receiving groove 54 between the paired handle halves when the blade is in either the open or the closed position. That is, the tang portion 66 is always located between the handle halves 24 and 26 of handle 12. The blade is pivotally attached to the handle with pivot shaft assembly 100, which extends in the Z direction, transverse to the plane of the blade.

Figure 6:
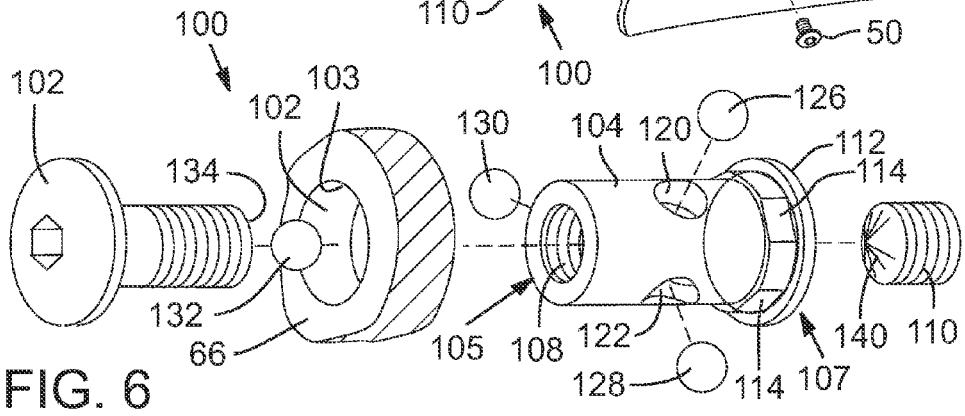
FIG. 6 is a perspective exploded view of the adjustable diameter pivot shaft according to the present invention.
Figure 7:
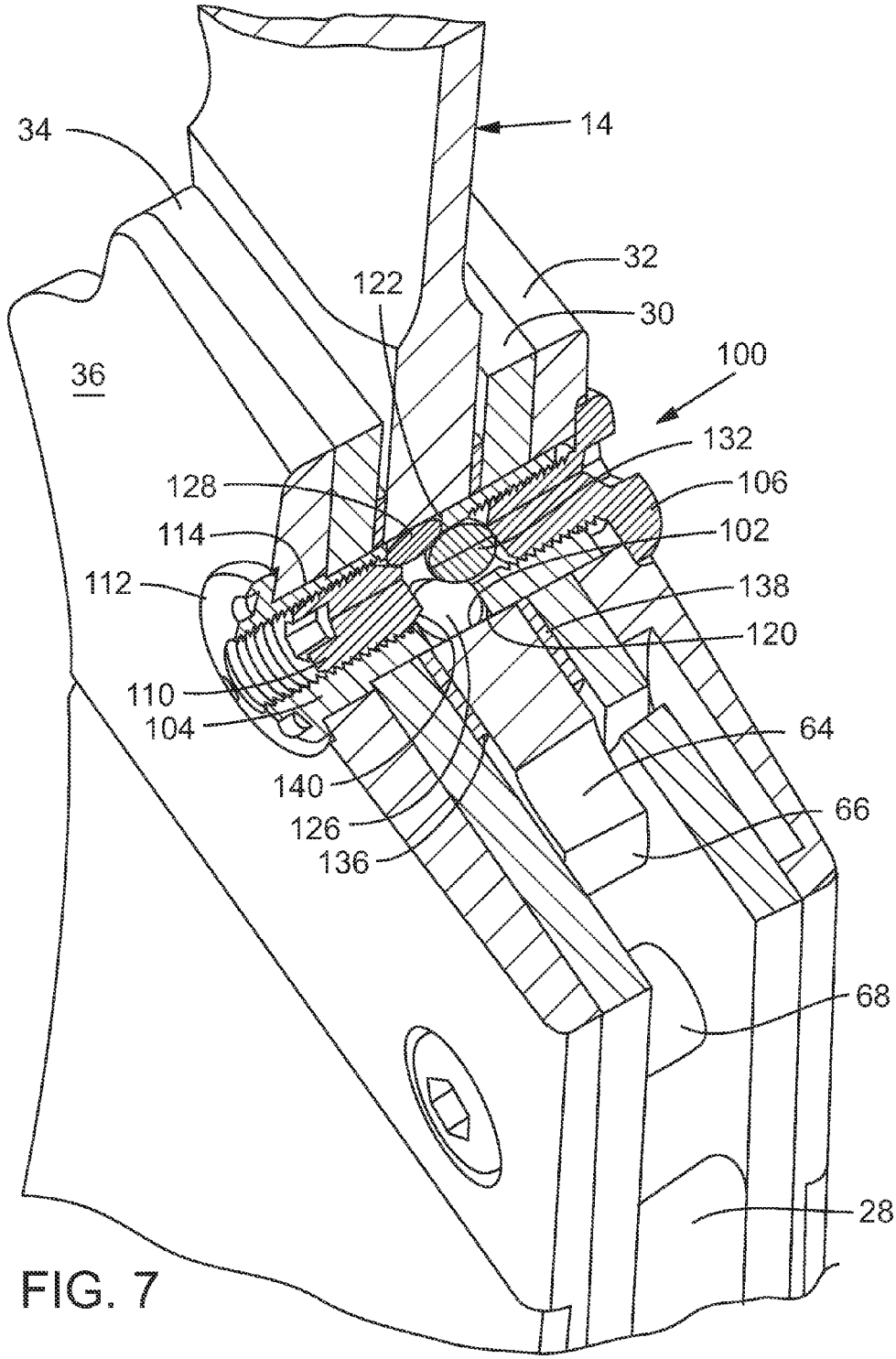
FIG. 7 is a perspective partial cross sectional view of a portion of the knife shown in FIG. 1 where the blade interconnects with the handle, and with the blade shown in the open position.

The pivot shaft assembly defines a blade pivot axis—the axis is the centerline through the pivot shaft that extends in the Z direction, transverse to the X-Y plane. Pivot shaft assembly 100 is shown in isolation in FIG. 6 and includes a cylindrical sleeve or shaft 104, a screw 106 that threads into first end 105 of the hollow, threaded interior 108 of shaft 104, and a set screw 110 that threads into second end 107 of the threaded interior 108 of shaft 104. As noted, shaft 104 has a hollow, threaded interior 108 so that the shaft defines a hollow cylinder. Second end 107 of shaft 104 has an oversized lip 112 and a series of planar faces 114 on the inner-facing side of the lip. The shaft has three bores formed approximately midway along its length, two of which are shown in FIG. 6 and which are identified with reference numbers 120 and 122. The third bore is identified with reference number 124. The three bores 120, 122 and 124 are axially arranged and evenly spaced around the shaft. Three ball bearings, labeled with reference numbers 126, 128 and 130 are received into the bores 120, 122 and 124, respectively. A fourth ball bearing 132 is received into the interior of shaft 104 and as detailed below, and is located between the interior end 134 of screw 106 and bearings 126, 128 and 130 in the assembled knife 10.

The pivot shaft assembly is assembled with knife 10 by inserting the shaft 104 through bore 44 in outer plate 36 until the series of planar faces 114 rest in the cooperatively formed bore 44. This cooperative geometric relationship between the planar faces 114 of shaft 104 and the planar faces of bore 44 prevents the shaft 104 from rotating relative to the outer plate 36. The shaft 104 is inserted through bore 42 in liner 34, bore 102 in tang portion 66 of blade 14, bore 40 of liner 30 and bore 38 of outer handle 32. The outer diameter of shaft 104 is slightly smaller than the diameter of bore 102. Stated another way, there is some clearance between the outside of the shaft and the inner surface 103 of the bore 102.

Figure 3:
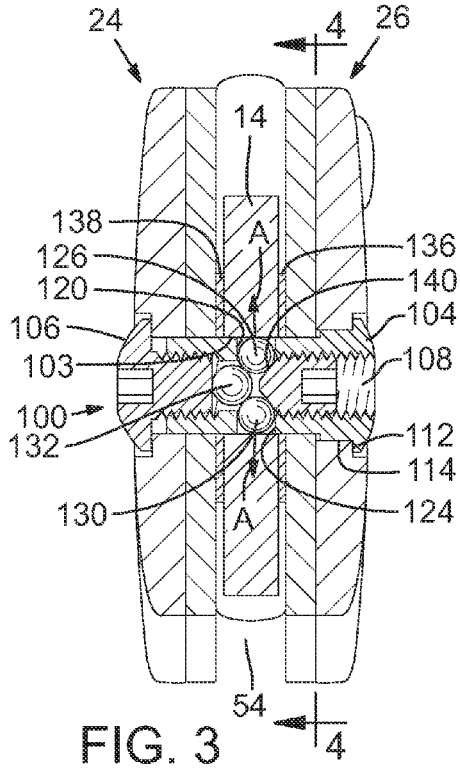
FIG. 3 is a cross sectional view taken along the line 3-3 of FIG. 1.

A first washer 136 is placed around shaft 104 between the inner-facing side of liner 34 and blade 14, and a second washer 138 is similarly placed between the inner-facing side of liner 30 and blade 14. With the shaft positioned with the handle components as just described, screw 106 is threaded into first end 105 of shaft 104 and is tightened. Again, shaft 104 is prevented from rotating as screw 106 is tightened because the series of planar faces 114 and the cooperative planar faces in bore 44. As seen in FIG. 3, when screw 106 is tightened in place, bores 120, 122 and 124 are aligned in handle 12 with the centerline of blade 14. At this point, ball bearing 132 is inserted into second end 107 of shaft 104. Ball bearing 132 rests on the interior end 134 of screw 106. Next, bearings 126, 128 and 130 are inserted into second end 107 of shaft 104. Each of these bearings is received into the respective bores 120, 122 and 124 in shaft 104.

Set screw 110 is next threaded into shaft 104. The inner tip 140 of set screw 110 is smoothly tapered. As such, when the set screw is threaded into the interior of shaft 104, the tapered tip 140 bears against the three bearings 126, 128 and 130 and these three bearings also bear against bearing 132, which naturally assumes its position the center of the three bearings 126, 128 and 130 as pressure is applied to the bearings with set screw 110. Optionally, a circularly concave divot 142 (see FIG. 5) may be formed in the axial center of the interior end 134 of screw 106 to located and position bearing 132, although as noted the bearing 132 will normally assume this position as set screw 110 is tightened.

Figure 4:
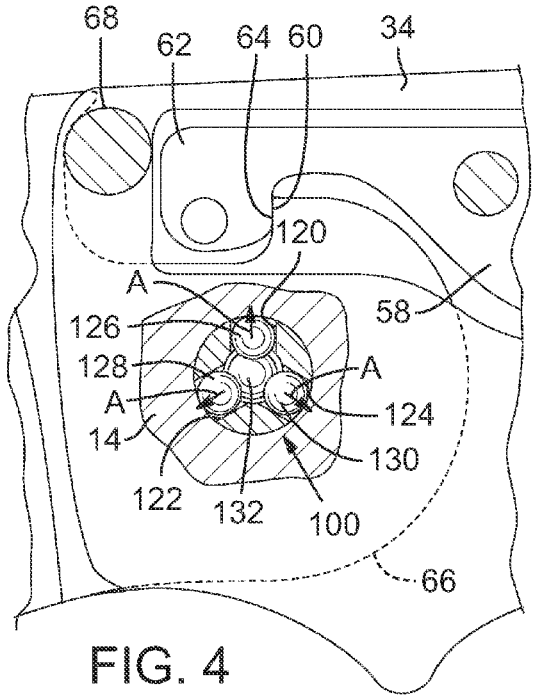
FIG. 4 is a cross sectional view taken along the line 4-4 of FIG. 3, showing only that portion of the knife and its structures around the blade/handle interconnection.

It will be appreciated that as set screw 110 is threaded more tightly into shaft 104 and bears against the bearings, the three bearings 126, 128 and 130 are forced outwardly from the axial centerline through the shaft, through the bores 120, 122 and 124, as illustrated with arrows A in FIGS. 3 and 4. This force is directed in the X-Y plane as set screw 110 is threaded inwardly in the Z direction. As set screw 110 is screwed more tightly against the bearings, the bearings are forced with greater pressure against the interior surface 103 of bore 102 through blade 14, effectively increasing the diameter of the pivot shaft and similarly effectively decreasing to zero the clearance between the pivot shaft and the blade. And although the diameter of the pivot shaft 104 has in this manner been increased so that the tolerance between the blade and the shaft is zero, the blade is easily rotated about the shaft between the open and closed positions by virtue of the bearings, which rotate relatively freely as the blade is rotated between the open and closed positions—the inner surface 103 of the bore 102 through blade 14 rotates over the bearings as the blade is moved from open to closed, and from closed to open.

Optionally, the set screw 110 described above with the tapered end could be replaced with a set screw having a planar inner surface and using a fifth ball bearing between the planar end of the set screw and the axially arranged bearings.

The amount of pressure applied by the bearings against the blade may be adjusted by varying the position of set screw 110. Because the bearings 126, 128 and 130 are bounded by the bores in which the bearings reside—that is, bores 120, 122 and 124, the bearings are urged only in the direction of arrows A, in the X-Y plane. In other words, any tendency of the bearings to be driven in any direction other than in the X-Y plane when set screw 110 is tightened is eliminated because the bores define the only route that the bearings are able to move. Set screw 110 may optionally include means for fixing the position of the screw to prevent loosening, such as nylon locking materials or other conventional screw locking mechanisms. Moreover, the set screw shown in the drawings utilizes a hex-type head, but any kind of set screw adjustment head may be used. Furthermore, bearing 132 may be eliminated by fabricating the inner end of screw 106 so that it replicates the shape of bearing 132.

Pivot shaft assembly 100 thus allows the effective diameter of the pivot shaft to be varied, and in the assembled knife 10 the diameter of the shaft is increased by screwing set screw 110 into shaft 104. This forces bearings 120, 122 and 124 outwardly so that they bear against the interior surface 103 of the bore 102 through blade 14. Because the bearings put pressure on the blade, tip wobble is eliminated. All of the bearings are preferably metallic or ceramic so that the blade 14 pivots smoothly and easily between the closed and open positions.

A first alternative embodiment of an adjustable diameter pivot shaft according to the present invention is shown in FIG. 8. There, pivot shaft assembly 200 includes a cylindrical sleeve or shaft 204, a screw 206 that threads into first end 205 of the hollow, threaded interior 208 of shaft 204, and a set screw 210 that threads into second end 207 of the threaded interior 208 of the shaft. Second end 207 of shaft 204 has an oversized lip 212 and is seated in outer plate 36 to prevent relative rotation between the shaft and the plate in the same manner described above with assembly 100. The shaft 204 has three bores formed approximately midway along its length, two of which are shown in FIG. 8 and which are identified with reference numbers 220 and 222. Three ball bearings, two of which are shown in FIG. 8 and labeled with reference numbers 226 and 228 are received into the bores 220 and 222, respectively (and the third bearing, which is not visible, is received into the third bore in the manner described above—although the third bore is not visible in FIG. 8). A first elastomeric pad 230 is located adjacent the interior end of screw 206 and a second elastomeric pad 232 is located adjacent the interior end of set screw 210, the interior end of which is flat, unlike the interior end of set screw 110 which is smoothly tapered. Fourth ball bearing 234 is positioned between first elastomeric pad 230 and bearings 226, 228 and the third bearing, and fifth ball bearing 236 is positioned on the other side of the three central bearings (226, 228, and the third bearing which is not visible in FIG. 8), between the central bearings and the second elastomeric pad 232.

The pivot shaft assembly 200 is assembled with knife 10 similarly to the process described above. Thus, shaft 204 is inserted through the bores in outer plate and inner plate, the blade, and the inner and outer plate on the opposite side of the blade. Washers 136 and 138 are placed around shaft 204 on opposite sides of the blade between the inner-facing side of the liners and the blade. With the shaft positioned with the handle components, screw 206 is threaded into first end 205 of shaft 204 and is tightened, thereby aligning bores 220 and 222 with the center of blade 14. At this point, ball bearing 234 is inserted into second end 207 of shaft 204. Ball bearing 234 rests on the first elastomeric pad 230 on the interior end of screw 206. Next, bearings 226, 228 and the third bearing are inserted into second end 207 of shaft 204. Each of these bearings is received into the respective bores in shaft 204. Fifth bearing 236 is then inserted into the shaft. At this point the three central bearings are each received into the respective bores in the shaft and the fourth and fifth bearings 230 and 232 are located in the center of the axially arranged three central bearings, 226, 228 and the third bearing, occluded in the view of FIG. 8.

Second elastomeric pad 232 is then inserted into second end 207 of the shaft, and set screw 210 is threaded into the shaft. When the set screw is threaded into the interior flat face of the screw bears against the second elastomeric pad 232, putting pressure on bearing 236, which as noted is positioned in the center of the three central bearings as shown in FIG. 8. This compresses all of the bearings inwardly, causing bearings 226, 228 (and the third bearing, not visible) to be forced outwardly from the axial centerline through shaft 204 in the direction of arrows A, so that the bearings apply pressure against the inner surface 203 of the bore through the blade. As set screw 210 is threaded more tightly into shaft 204 and compresses the bearings, the three central bearings 222, 228 are forced in the X-Y plane, effectively increasing the diameter of the pivot shaft and similarly effectively decreasing to zero the clearance between the pivot shaft and the blade.

A second alternative embodiment of an adjustable diameter pivot shaft according to the present invention is shown in FIGS. 9 through 12. There, pivot shaft assembly 300 includes an outer sleeve 302 that has plural slots 304 formed therein in the manner of kerf cuts forming a collet. The sleeve is manufactured from a resilient material such as spring steel and the slots allow the sleeve to either expand (and thus increase the outer diameter of the sleeve) or contract (and thus decrease the outer diameter of the sleeve). The outer sleeve 302 has a tapered internal 306 surface that is received on a shaft 308 that has an oppositely tapered outer surface 310. As detailed below, when the shaft 308 is moved axially relative to the sleeve 302, the outer surface 310 pushed against the internal surface 306, which causes the sleeve 302 to expand so that the diameter of the sleeve and thus the diameter of the pivot shaft is increased. It is preferable that the outer sleeve 302 cannot rotate around the shaft 308, for instance when the blade is moved between the open and closed positions. Means are thus provided to prevent the sleeve from rotating on the shaft. While there are numerous structures that may be used to prevent rotation of the sleeve on the shaft, as one example in FIG. 10, a tab 305 on the tapered outer surface 310 of shaft 308 aligns in one of the slots 304 of sleeve 302 to prevent the sleeve from rotating on the shaft when assembled together.

Figure 10:
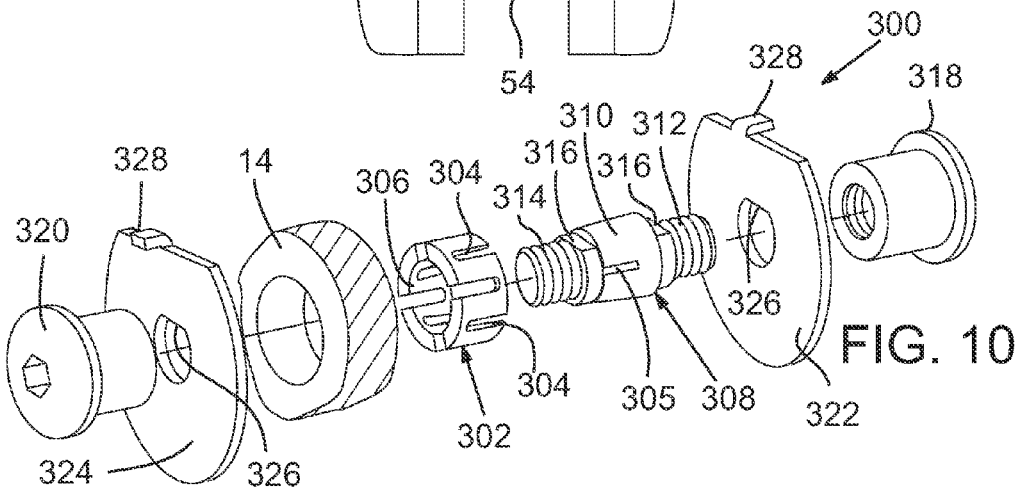
FIG. 10 is a perspective exploded view of the embodiment of the adjustable diameter pivot shaft shown in FIG. 9.

The shaft 308 has threaded opposite ends, labeled 312 and 314 in FIG. 10, a tapered center section that defines tapered surface 310, and flattened portion 316 on both sides of the center section. In the assembled knife, the threaded end 312 is threaded into a first set screw 318 and the opposite threaded end 314 is threaded into a second set screw 320. A washer is positioned on both sides of the blade 14, between the blade and the liners 32 and 34. Specifically, a washer 322 has a D-shaped central opening with a flattened portion 326 that mates with flattened portion 316 on shaft 308. A tab 328 on an outer peripheral edge of the washer is received into a slot 330 in liner 34. The combination of the tab 328 received in the slot 330, and the flattened portion 316 on shaft 308 mating with the cooperative flattened portion 326 on the washer, define an anti-rotation mechanisms that prevents shaft 308 from rotating in the assembled knife. Another manner of building in the anti-rotation feature is to form a D-shaped opening in the liners 32 and 34, thus eliminating the need for the D-shaped opening in the washers, and the tabs 328.

Figure 9:
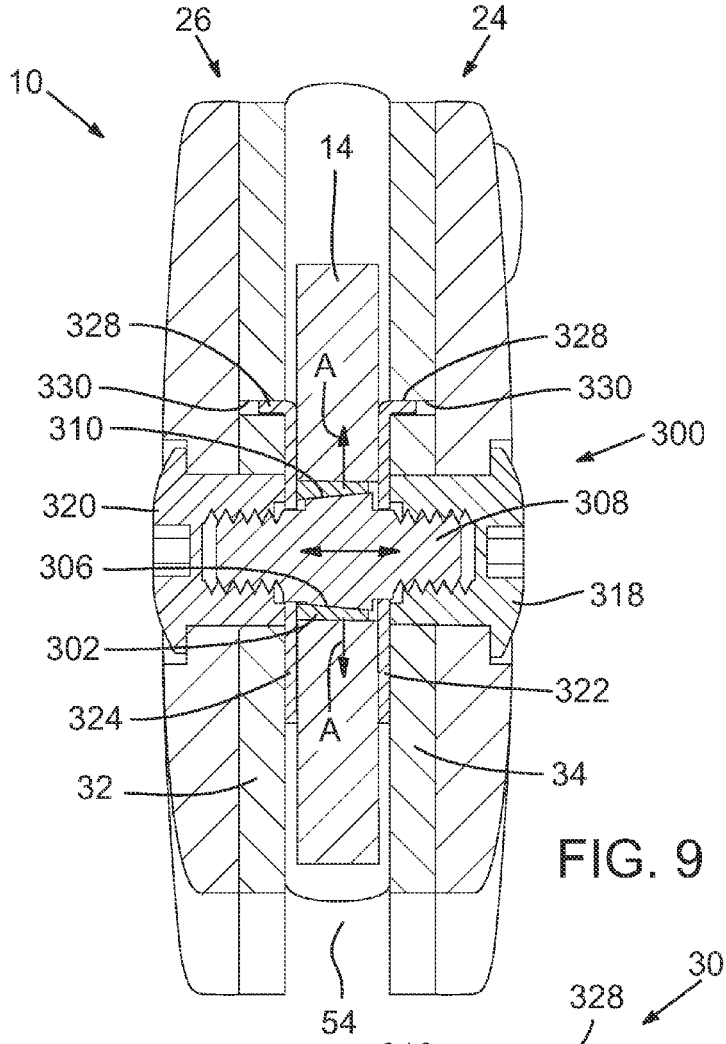
FIG. 9 is a cross sectional view similar to the views of FIGS. 3 and 8, illustrating another alternative embodiment of an adjustable diameter pivot shaft.

The pivot shaft assembly 300 is assembled with knife 10 as shown in FIG. 10 by sliding sleeve 302 over the central, tapered portion of the shaft 308 such that the tapered interior surface 306 of sleeve 302 nests against the oppositely tapered outer surface 310 of shaft 308. The shaft is then inserted through the pivot bore in blade 14 and the washers 322 and 324 are slid over the opposite ends of the shaft with the flattened portions aligned. The blade and pivot shaft assembly is then assembled with the handle halves, and the set screws 318 and 320 are inserted through the bores in the handle and threaded onto the ends of the shaft 308. It will be appreciated that the outer surface of the sleeve 302 defines the surface on which blade 14 rotates and, as best seen in FIG. 9. As such, the outer surface of the sleeve 302 is preferably polished smoothly and/or coated with compounds tending to smooth the surface. As also seen in FIG. 9, one end of the sleeve 302 abuts washer 324, in FIG. 9 the end of the sleeve on the left side of the drawing, preventing the sleeve from moving toward the left.

With the knife 10 assembled, the diameter of the pivot shaft is adjusted to provide the desired tolerance between the sleeve 302 and the bore in the blade. This is done, for example with reference to the embodiment of FIG. 9, by loosening screw 318 slightly and then either tightening or loosening screw 320. As screw 320 is adjusted, shaft 308 is pulled or pushed axially in the direction transverse to the major plane of blade 14—that is, in the direction of arrow B in FIG. 9. As the shaft moves in this direction, the tapered outer surface of the central portion of shaft 108 moves relative to the oppositely tapered inner surface 306 of sleeve 302, which as noted previously abuts washer 324 and is unable to moving in the direction toward that washer. As the shaft thus moves relative to the sleeve the diameter of the sleeve increases or decreases (depending upon which direction the shaft is being moved), as shown with arrow A (illustrating an increase in the diameter of the sleeve). As described previously, sleeve 302 includes plural slots 304 that allow the sleeve to expand or contact in the manner of a collet. It will be apparent that as the tapered surfaces 306 and 310 move relative to and against one another, the outer diameter of the sleeve gets larger or smaller depending on the direction that the shaft is moved relative to the sleeve. More specifically, with continuing reference to FIG. 9, with screw 318 slightly loose, as screw 320 is tightened (i.e., rotated clockwise), shaft 308 is pulled into screw 320 (to the left in the view of FIG. 9). As the shaft moves and tapered outer surface 310 moves relative to tapered inner surface 306, the diameter of sleeve 302 increases. It will thus be appreciated that the diameter of sleeve 302 is decreased by loosening screw 320.

With the diameter of the pivot shaft set to the desired position, screw 318 is tightened to complete the assembly process. It will be appreciated that by varying the tolerance between the sleeve 302 and the blade 14, the amount of force required to rotate the blade about the pivot shaft from closed to open, and vice versa, may be varied.

Figure 11:
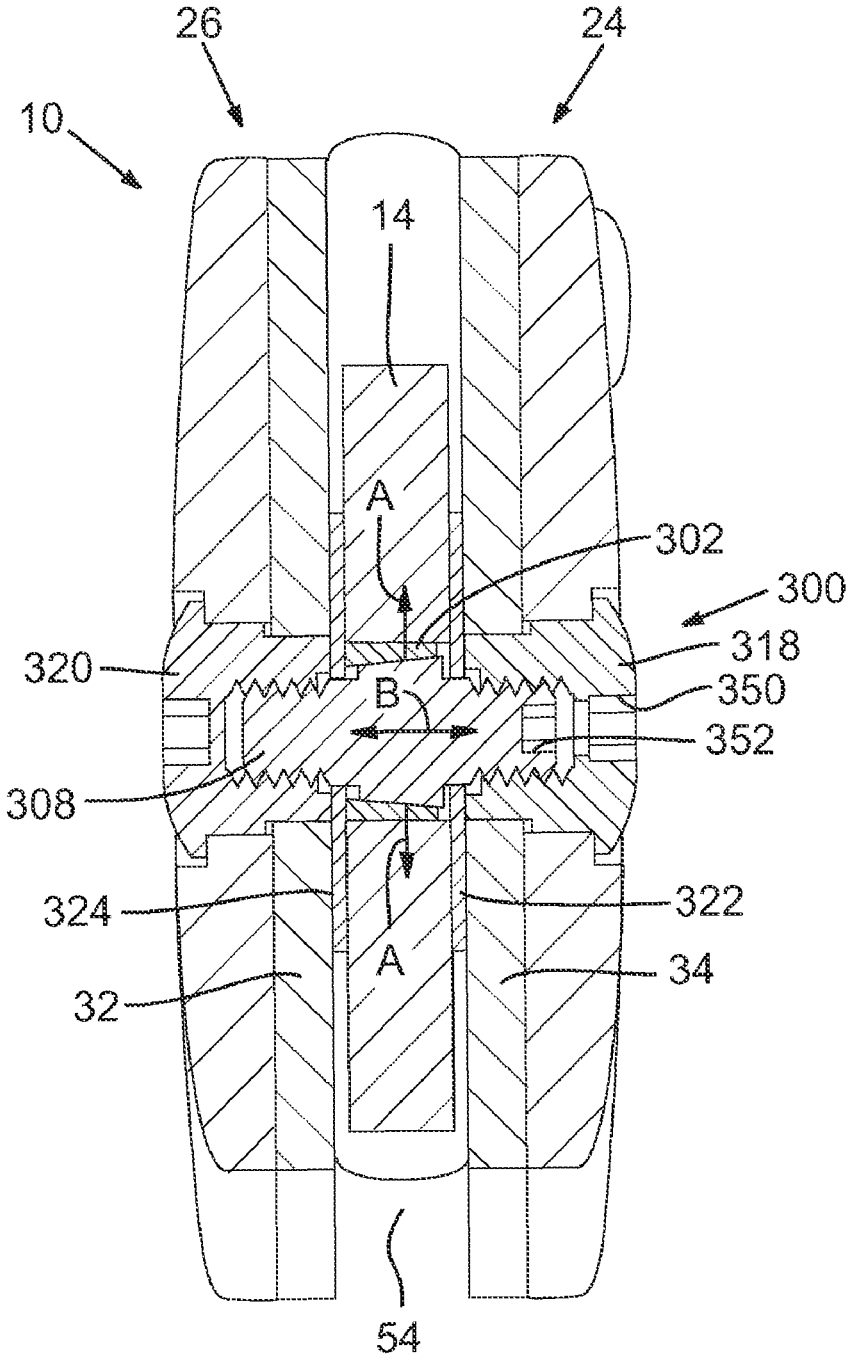
FIG. 11 is a cross sectional view of the embodiment of the adjustable diameter pivot shaft shown in FIG. 8, illustrating an alternative mechanism for adjusting the diameter of the pivot shaft.

FIG. 11 illustrates a pivot shaft assembly 300 that is substantially the same as the pivot shaft described above and shown in FIGS. 9 and 10, insofar as it includes an expandable sleeve 302, but shows an alternative mechanism for adjusting the position of shaft 308 in the handle and thus the diameter of the pivot shaft. In FIG. 11, screw 318 has a hex wrench opening 350 which is a through opening that opens to the interior of the screw. The outer end of shaft 308 includes a hex opening 352 that is smaller in size than opening 350. To adjust the diameter of the pivot shaft, a hex wrench that fits hex opening 352 is inserted through opening 350 to engage hex opening 352 and to rotate the shaft 308, and thereby move the shaft in the left or right direction in FIG. 11 (i.e., arrow B). As described above, this enlarges or decreases the diameter of sleeve 302. With the mechanism shown in FIGS. 11 and 12 it is necessary to rotate the shaft 308 to move the shaft axially; as such, the washers 322 and 324 do not include the anti-rotation structures described above with reference to FIG. 9.

Figure 12:
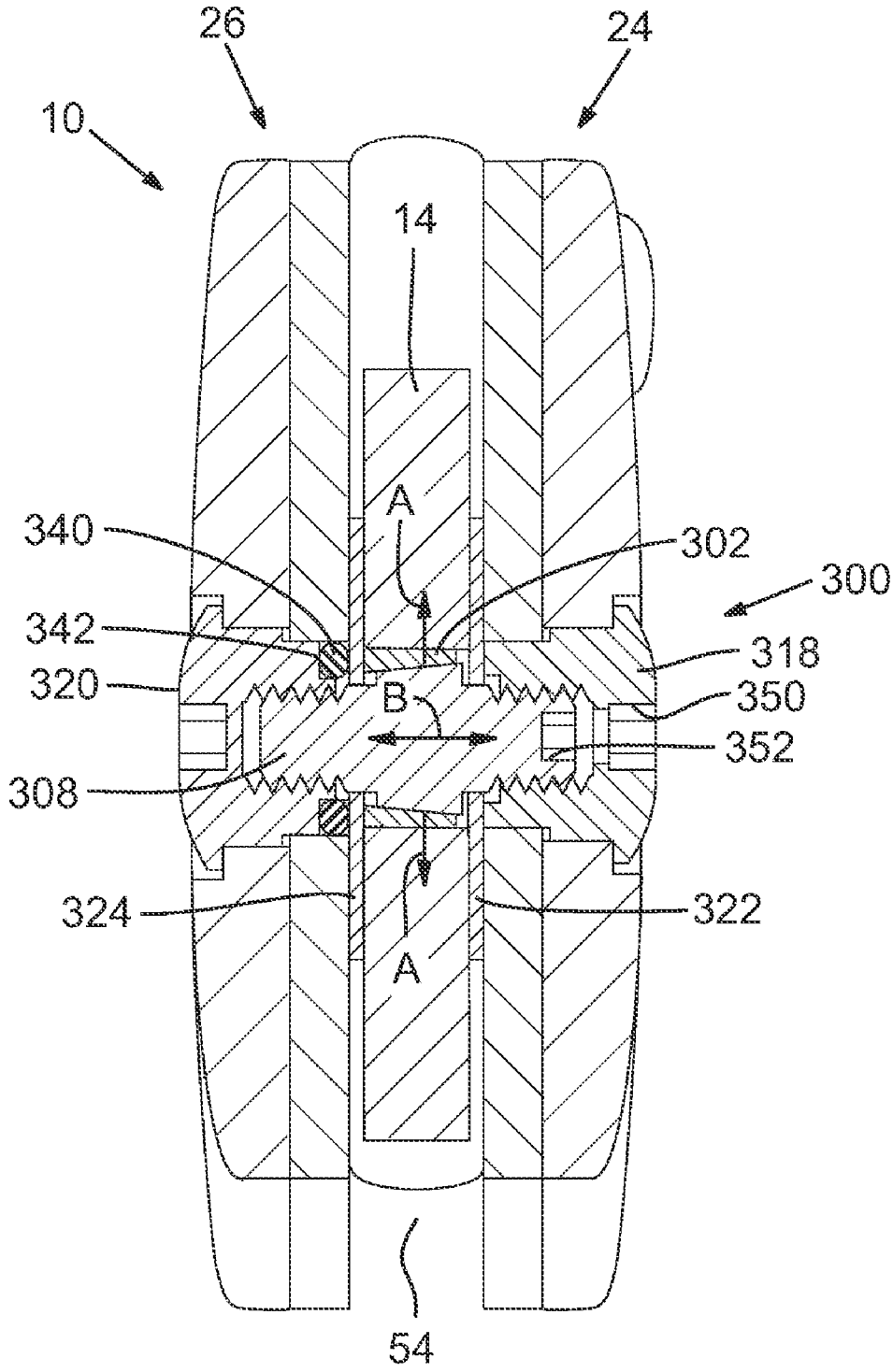
FIG. 12 is a cross sectional view of the embodiment of FIG. 11 illustrating a resilient ring that functions to maintain the position of the internal threaded screw.

The pivot shaft assembly shown in FIG. 12 is identical to that shown in FIG. 11, but further includes a resilient ring 340 surrounding the pivot shaft 308 between washer 324 and a seat 342 formed in screw 320 for retaining the resilient ring. When the knife 10 is assembled, the resilient ring is compressed and this causes pressure to be exerted against washer 324 and thus on sleeve 302, which is abutting the washer. The pressure applied to sleeve 302 maintains the sleeve in the desired position and thus maintains the desired diameter of the pivot shaft.

Returning to FIG. 10, it will be recognized that there are numerous manners in which slots 304 may be formed in the sleeve 302 in order to allow the sleeve to be enlarged. The slots 304 shown in the figure extend roughly parallel to the axis through the sleeve. However, the slots could be oriented at angles relative to the axis, or radially or in other geometric configurations. Unlike the embodiments illustrated in FIGS. 1 through 8 and described above, in which the ball bearings make point contact with the tang of the blade, with the embodiment shown in FIGS. 9 through 12 there is contact between the outer surface of outer sleeve 302 and the bore through the tang of the blade over the entire surface of the sleeve. This results in a relatively stronger configuration and contributes to minimization of relative movement between the blade and the handle when the blade is in the open position.

Those of skill in the art will readily appreciate that from a functional point of view, the pivot shaft assemblies 100, 200 and 300 described above and shown in the drawings serve to vary the diameter of the pivot shaft, and as noted, in doing so as the diameter of the pivot shaft increased, decrease the clearance between the pivot shaft and the blade (or other implement) to zero. There are many equivalent structures to those described herein that may be employed to accomplish these functional objectives. For example, a cassette of needle bearings may be used with the pivot shaft, fitted with mechanisms to urge the needle bearings outwardly from the shaft. Roller bearings likewise may be utilized. These modifications illustrate that the number of bearings is not fixed at three, but can be as few as two bearings and include more than three. Thus, for example, the sleeve 104 could include more than three bearings if desired.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A hand tool having an adjustable diameter pivot shaft, comprising:

a handle having first and second handle halves held in a spaced apart relationship to define an implement groove between the handle halves;

an implement pivotally connected between the handle halves with a pivot shaft extending through a bore in a tang portion of the implement, the pivot shaft attached to the handle halves so that the implement is movable between an open position and closed position about said pivot shaft; wherein said pivot shaft is defined by an outer sleeve that extends through the bore in the implement and an inner shaft extending through the interior of the outer sleeve, said inner shaft being axially movable relative to the outer sleeve, and wherein movement of the inner shaft causes the diameter of the outer sleeve to change.

2. The hand tool according to claim 1 wherein the outer sleeve has a tapered inner surface that contacts an oppositely tapered surface on the pivot shaft.

3. The hand tool according to claim 2 wherein movement of the inner shaft in a first direction relative to the outer sleeve causes the diameter of the outer sleeve to increase.

4. The hand tool according to claim 1 wherein the outer sleeve has a plurality of slots formed therein.

5. The hand tool according to claim 1 including means to prevent said outer sleeve from rotating around said inner shaft.

6. The hand tool according to claim 5 wherein the means to prevent said outer sleeve from rotating around said inner shaft includes a tab formed on a surface of the inner shaft that is received in a cooperative slot in the outer sleeve.

7. The hand tool according to claim 1 including means to prevent rotation of the inner shaft.

8. In a hand tool having a handle having first and second handle halves held in a spaced apart relationship to define an implement groove between the handle halves, an implement pivotally connected between the handle halves with a pivot shaft extending through a bore in a tang portion of the implement, the pivot shaft having a pivot shaft axis and attached to the handle halves so that the implement is movable between open position and closed positions about said pivot shaft, the improvement comprising:

an expandable sleeve around said pivot shaft, said expandable sleeve extending through the bore in the tang portion of the implement and wherein movement of said pivot shaft along the axis thereof causes the expandable sleeve to expand.

9. The hand tool according to claim 8 wherein the diameter of the pivot shaft may be increased so that the entire outer surface of the expandable sleeve is in contact with an interior surface of the bore in the tang portion of the implement.

10. The hand tool according to claim 8 wherein the expandable sleeve has a tapered inner surface that makes contact with an oppositely tapered outer surface of said pivot shaft.

11. The hand tool according to claim 10 wherein movement of the pivot shaft in a first direction relative to the expandable sleeve causes the tapered inner surface of the expandable sleeve to move on the oppositely tapered outer surface of the pivot shaft to increase the diameter of the expandable sleeve.

12. The hand tool according to claim 10 wherein the expandable sleeve has a plurality of slots formed therein.

13. The hand tool according to claim 8 wherein the expandable sleeve cannot rotate relative to the pivot shaft.

14. In a hand tool having a handle and an implement pivotally attached to the handle, a method of reducing relative movement between the handle and the implement when the implement is in an open position, the method comprising the steps of:

a) rotatably attaching the implement to the handle by passing a pivot shaft through a pivot shaft bore in the implement, the inner diameter of the pivot shaft bore being greater than the outer diameter of the pivot shaft, and attaching the opposite ends of the pivot shaft to opposed handle halves; and b) increasing the diameter of the pivot shaft until the pivot shaft contacts the inner diameter of the pivot shaft bore.

15. The method according to claim 14 including the steps of providing the pivot shaft having a central longitudinal axis with plural bores extending through an outer surface of the shaft into a hollow core of the shaft, and inserting ball bearings into each of said bores.

16. The method according to claim 14 including the steps of providing the pivot shaft with an expandable sleeve having an outer diameter, and causing the outer diameter of the expandable sleeve to increase.

17. The method according to claim 16 wherein the pivot shaft has an axis and step b) includes the step of moving the pivot shaft axially relative to the expandable sleeve.

18. The method according to claim 17 wherein moving the pivot shaft axially causes pressure to be exerted against the expandable sleeve and causes the outer diameter of the expandable sleeve to increase.

19. The method according to claim 18 including the step of preventing the expandable sleeve from rotating around the pivot shaft as the as the implement is rotated.

20. The method according to claim 19 including the step of preventing rotation of the pivot shaft relative to the handle.

* * * * *